United States Patent [19]

Vetter et al.

[11] 4,067,544

[45] Jan. 10, 1978

[54] PNEUMATIC FLAT PADS

[76] Inventors: Manfred Vetter, Burg, Zulpich-Langendorf, Germany, D5352; Hans Kempken, Frankfurter Str. 110, Troisdorf, Germany, D5210

[21] Appl. No.: 746,126

[22] Filed: Nov. 30, 1976

[30] Foreign Application Priority Data

Dec. 1, 1975 Germany ..... 7538274[U]

[51] Int. Cl.[2] ..... B66F 3/24

[52] U.S. Cl. ..... 254/93 HP

[58] Field of Search ..... 254/93 HP

[56] References Cited

U.S. PATENT DOCUMENTS 1,752,101 3/1930 Meutsch ..... 254/93 HP

FOREIGN PATENT DOCUMENTS 2,269,487 12/1975 Germany ..... 254/93 HP 2,405,788 8/1975 Germany ..... 254/93 HP

*Primary Examiner*—Robert C. Watson

[57] ABSTRACT

A pneumatic pad has two opposite covers of flexible material joined at their margins by a marginal area to form a hermetically sealed hollow space between them. The covers each contain reinforcing cord inserts. At least one cord insert of one of the covers is laid across the marginal area of the pad and extends to the other cover to overlap a portion of the cord insert of the other cover. A valve attachment to connect the hollow space to a source of compressed air is provided.

25 Claims, 2 Drawing Figures

PNEUMATIC FLAT PADS

BACKGROUND OF THE INVENTION

The invention is concerned with a pneumatic flat pad with two marginally joined covers of flexible material which form between themselves a hermetically sealed hollow space and are reinforced by cord inserts, and a perforated attachment for connecting the hollow space with a source of compressed air.

As pneumatic lifting devices, particularly for the technical auxiliary service as car jacks and the like, pneumatic flat pads are known which are inflated by means of compressed air and can, while being expanded, perform a lifting operation.

These pads, preferably as flat as possible, are frequently provided with cord inserts for reinforcing the covers. The cord inserts are vulcanized into the covers, which consist of natural or synthetic rubber, in several plies which are always crossed at 90° relative to each other because each cord insert possesses high strength only in one direction and it is intended to achieve by crosswise superposition of the cord inserts the same reinforcing effect in all plane directions of the cover, that is to say, to create isotropic conditions.

Such known pneumatic flat pads have, however, the disadvantage that they can be easily destroyed in the case of higher pressures in the marginal area where the two covers are joined with each other, which brings about a high risk of accidents, not only by the bursting of the pad itself but also by the sudden drop of the propped up load.

The invention has set itself the task to exclude the risk of damage or destruction in the area of the borders existing in the case of the known flat pads of the kind mentioned above.

SUMMARY OF THE INVENTION

This problem is solved according to the invention by an arrangement in which at least one of the cord inserts of one of the covers is laid around to the other cover over at least a marginal area of the pad and overlaps a portion of the other cover's cord insert(s).

By means of the invention it is achieved that the pads receive sufficient reinforcement in the most endangered zones, that is in the marginal areas, which reinforcement prevents rupture of the pads under the pressure of the compressed air charge. The operating safety is thereby improved and the useful life of the pads lengthened.

The term "cord" is here to be understood in its technical meaning and indicates laminar formations with parallel threads or bundles of threads, which are highly resistant to tearing and fatiguing, and particularly to cords made of synthetic fibers like nylon or steel. These cord formations can be systems without cross threads ("woofless cord") or they can be fastened with a relatively few cross threads ("cord weaves"). Steel cord is usually woofless. As already stated above, the marginal areas of the pads are particularly endangered because the covers bend with inflation into the shape of a vault and tend to separate, so that all traffic stresses have to be absorbed by the lateral joints. In the case of angular, for instance square or rectangular pads, the tractive forces concentrate apart from this in the median marginal zones between the corners, whereas the corners themselves are subject to less deformation. It is therefore suitable to make the marginal areas particularly wear-resistant. This can be done by, in addition to the arrangement of the insert(s) according to the invention, embedding a textile or fiber reinforcement, for example, glass fibers, in the marginal areas, by increasing the wall thickness or the thickness of the marginal areas, by making at least the marginal areas of a material resistant to cutting, or providing them with such a covering, for example, a covering of a fabric resistant to cutting, and/or by furnishing the pads in a manner known per se with an inner and outer tape-lapping which envelopes the endangered marginal areas in the direction of the lines of force.

The cord inserts wrapped around the marginal areas according to the invention do not have to occupy the entire cover surface either on the side of the pad from which they start out or on the opposite side of the pad where they overlap the insert(s) present there. Also, it is not required and, having in mind the lowest possible over-all height of the pad, usually not desirable to have the wrapped-around ends of one and the same cord insert overlap. A strip of cord insert suffices thus for instance which is arranged in the zones of the marginal area to be reinforced and overlaps on both sides of the cover the cord inserts present there only to such an extent that a firm joint with the latter and the covers, respectively, is assured.

Furthermore, the cord inserts of the covers can consist of material, for instance steel cord, different from the one for the cord inserts which reinforce the marginal areas and consist for instance of fiberglass or plastics. For the latter cord textiles can be advantageous since they have sufficient cohesion opposite the woofless cord also at a right angle to the principal direction of the thread, which can facilitate their arrangement in the course of the manufacturing procedure.

BRIEF DESCRIPTION OF THE DRAWINGS

Further characteristics and advantages of the invention can be gathered from the following description of a preferred embodiment of the invention, explained as follows with reference to the drawing in which.

DESCRIPTION OF THE PREFERRED EMBODIMENTS

Figure 2:
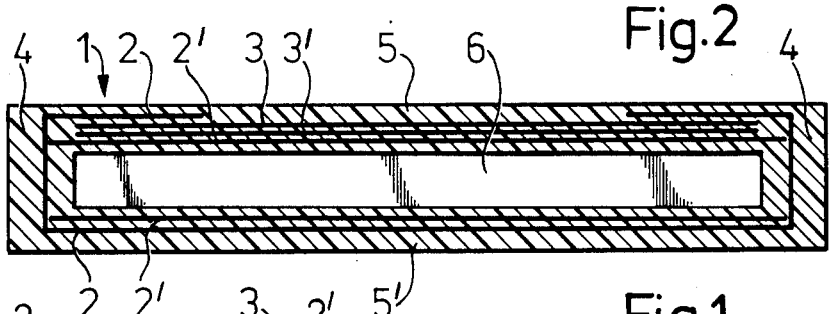
FIG. 2 is a cross section along line II—II of FIG. 1.
Figure 1:
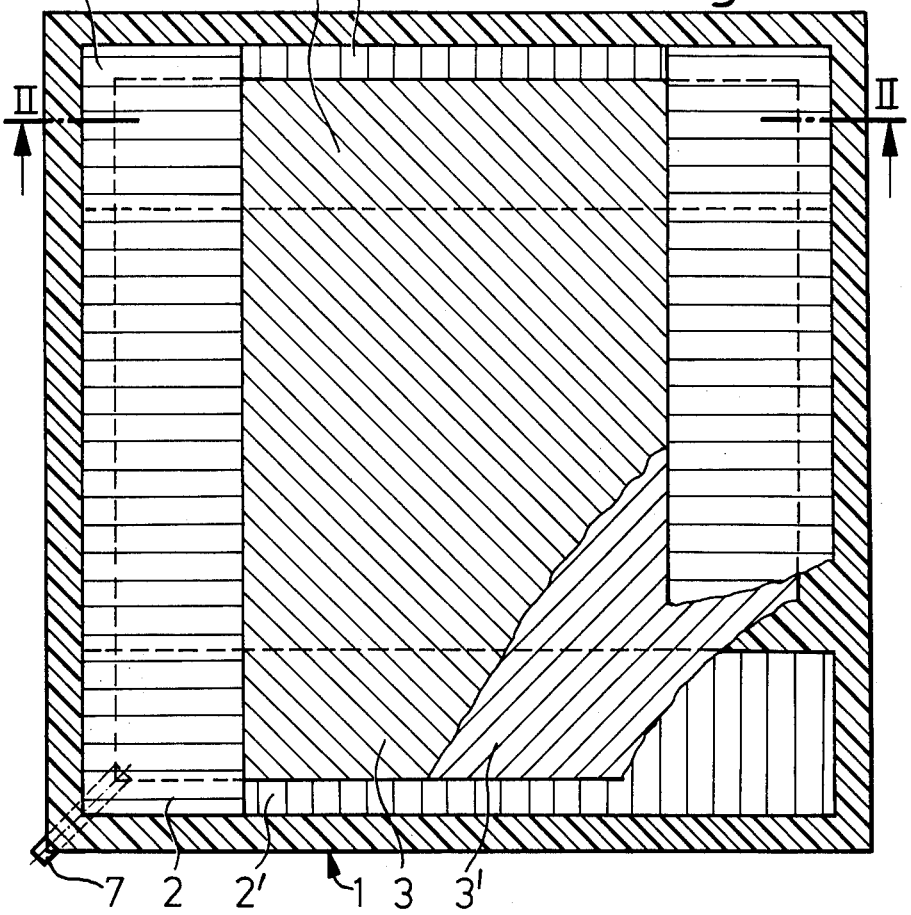
FIG. 1 is a top view of a pneumatic flat pad according to the invention.

The pneumatic flat pad 1 has a top cover 5 and a bottom cover 5' which are laterally joined by marginal zones or joints 4 or consist of a single piece with the latter. The covers 5 and 5' form with the marginal joints 4 an airtight hollow space 6 which by means of a perforated connecting piece 7, preferably leading through a corner of the pad 1 toward the outside, and may be for instance a valve, a hose coupling or a molded-on mouthpiece, which can be connected to a source of compressed air. The representation is a schematic one and allows recognition of the individual plies of the pad 1.

The covers 5, 5' consist, depending on the application in which the pad is to be used, of an elastic synthetic material, resistant to oil or chemicals, possibly noncombustible or self-extinguishing, respectively, or of rubber, for example, neoprene, and the covers can have on their outside a skid-resistant corrugation or a gripping embossed profile, or they can be provided with loops, (not shown).

The covers 5, 5' are reinforced with cord inserts 2, 2', 3, 3'. These cord inserts 2, 2' and 3, 3' are laminar formations, as they are known for instance from the tire manufacture. The course of the longitudinal cord threads is indicated by lines. The cord inserts 2 and 2' are crossed in a manner known per se by 90° against each other (so that the respective courses of their cord threads are at 90°) and extend through the marginal zones 4 on all four sides of the pad 1. The bent-over borders of the inserts 2, 2' lap over the two also crosswise superimposed inserts 3 and 3'.

In the illustrated embodiment the inserts 3, 3' are somewhat smaller than the extent of the cover 5 in the plane surface and its borders are not bent over.

As can be seen from FIG. 2, an additional reinforcement occurs in the case of the illustrated embodiment in the corner areas of the top cover 5 by the overlapping cord inserts. In the marginal areas 4 proper, particularly if they have a considerably higher wall thickness than the covers 5, 5' (compare the drawing FIG. 2), it may suffice to lay over as reinforcement only one cord insert. For high demand service it is however suitable to lay around at least two of the inserts also in the marginal areas 4. In any case the longitudinal cord threads have to be aligned in such a way that they absorb to the largest possible extent the tractive forces generated in its marginal areas 4 when the pad 1 is inflated.

For the cord inserts steel cord is preferably used according to the invention; also the use of poorly expandable, fatigue-proof synthetics has to be taken into consideration, possibly in combination with steel cord.

The cord inserts are fastened to each other or on the covers respectively, or embedded in the latter, by vulcanization in a heated shell mold during the injection process or other molding procedure or by any other manufacturing method.

In the drawing the pneumatic flat pad 1 according to the invention is shown schematically represented in a rectangular shape. It is however advisable for reason of increased ruggedness to round off the corners of the pad 1 or to give the latter, seen as a whole in top view, a round shape. The bentover edges of the insert(s) have in this case to be pleated or notched in a manner known in itself, so that the curvature can be evened out without building up the overlappings.

What is claimed is:

1. A pneumatic flat pad with two opposed covers of flexible material spaced apart from each other and joined at their margins by a marginal joint so that the two covers and lateral marginal joint cooperate to form between them a hermetically sealed hollow space, a plurality of cord inserts embedded within said covers, each of said covers being reinforced by at least one embedded cord insert, an attachment connecting said hollow space to a source of compressed air, and at least one of the at least one cord inserts of one of the covers being embedded within and extending through the lateral marginal joint of the pad to the other cover in which it is also embedded and within which it overlaps a portion but less than all of the at least one cord insert of the other cover.

2. The pneumatic flat pad according to claim 1, in which the cord inserts contain synthetic materials resistant to tearing, expansion and fatigue.

3. A pneumatic flat pad according to claim 1 in which the cord inserts contain steel cord.

4. A pneumatic flat pad according to claim 1, in which the pad has corner areas which are reinforced.

5. A pneumatic flat pad according to claim 4, in which the attachment for connection to the compressed air is located in one of the corner areas of the pad.

6. A pneumatic flat pad according to claim 1, in which the attachment for connection to the compressed air is a valve.

7. A pneumatic flat pad according to claim 1, in which the marginal area between the covers is formed in one piece with the covers.

8. A pneumatic flat pad according to claim 7, in which the marginal area has a greater wall thickness than the covers.

9. A pneumatic flat pad according to claim 1, further including a reinforcement member embedded in the marginal area.

10. A pneumatic flat pad according to claim 1, in which at least the marginal area is made of a material resistant to cutting.

11. A pneumatic flat pad according to claim 1, in which the pad is provided with a tape-lapping which envelopes the marginal areas and the lapping is disposed in the direction of the lines of force acting on the pad in use.

12. A pneumatic flat pad according to claim 1, in which the cord insert in the zone of the marginal area is in the form of a strip which overlaps the respective cord inserts located in the opposed covers forming a firm joint with the cord inserts and the covers respectively.

13. A pneumatic flat pad according to claim 1, in which the at least one insert in the covers consists of a material different from that of the cord insert which is laid across the marginal area.

14. A pneumatic flat pad according to claim 1, in which the cord inserts laid across the marginal area comprise textile-fabric cords.

15. A pneumatic flat pad according to claim 1, in which the covers comprise a material resistant to oil.

16. A pneumatic flat pad according to claim 15, in which the cord inserts laid across the marginal area are embedded in the covers during the manufacture of the pad.

17. A pneumatic flat pad according to claim 1, in which the cord threads of the cord inserts laid across the marginal area extending from one cover to the other cover are longitudinally aligned with the tractive forces generated by the inflation of the pad.

18. A pneumatic flat pad according to claim 1, in which the pad has corners and the corners are rounded off.

19. A pneumatic flat pad according to claim 1, in which the covers of the pad have a circular shape.

20. A pneumatic flat pad according to claim 19, in which the cord insert(s) laid across the marginal area have turned over borders which are notched to even out the marginal curvature.

21. A pneumatic flat pad according to claim 19, in which the cord insert(s) laid across the marginal area have turned over borders which are pleated to even out the marginal curvature.

22. A pneumatic flat pad according to claim 1, in which the covers comprise a material resistant to chemicals.

23. A pneumatic flat pad according to claim 1, in which the covers comprise a material which is noncombustible.

24. A pneumatic flat pad according to claim 1, in which the covers comprise a material resistant to cutting.

25. A pneumatic flat pad according to claim 1, in which the marginal area is covered with a material resistant to cutting.

* * * * *